US006793189B1

(12) United States Patent
McKay

(10) Patent No.: US 6,793,189 B1
(45) Date of Patent: Sep. 21, 2004

(54) TIE DOWN DEVICE

(76) Inventor: Kenneth J. McKay, 12 Hardscrabble Rd., Chester, NY (US) 10918

( * ) Notice: Subject to any disclaimer, the term of this patent is extended or adjusted under 35 U.S.C. 154(b) by 0 days.

(21) Appl. No.: 10/687,279

(22) Filed: Oct. 16, 2003

Related U.S. Application Data

(60) Provisional application No. 60/419,763, filed on Oct. 21, 2002.

(51) Int. Cl.[7] ..... B63B 21/04

(52) U.S. Cl. ..... 248/499; 224/534; 410/116; 114/218; 114/230.1

(58) Field of Search ..... 248/499, 505, 248/503, 500, 231.9, 231.91, 538, 539; 410/115, 116; 114/218, 230.1; 224/534; D8/367, 370, 371; 24/265 CD, 265 R, 115 M, 16 R

(56) References Cited

U.S. PATENT DOCUMENTS

| | | | | | |
|---|---|---|---|---|---|
| 864,937 | A | * | 9/1907 | Thompson | 24/130 |
| 3,381,925 | A | * | 5/1968 | Higuchi | 410/116 |
| 3,703,875 | A | * | 11/1972 | Gunvalson | 114/230.29 |
| 4,235,409 | A | * | 11/1980 | Cummings | 248/538 |
| 4,297,963 | A | * | 11/1981 | Beacom | 114/230.29 |
| 4,344,378 | A | * | 8/1982 | Martin | 114/218 |
| 4,358,281 | A | * | 11/1982 | Woodward | 440/109 |
| 4,899,680 | A | * | 2/1990 | Russell, Jr. | 114/230.29 |
| D321,470 | S | * | 11/1991 | Gerrard | D8/356 |
| D342,477 | S | * | 12/1993 | Lovelady et al. | D12/215 |
| 5,625,974 | A | * | 5/1997 | Demaio | 43/21.2 |
| 5,690,042 | A | * | 11/1997 | Bentley | 114/39.24 |
| 5,873,319 | A | * | 2/1999 | Bentley | 114/230.2 |
| D411,099 | S | * | 6/1999 | Smith | D8/367 |
| 5,941,191 | A | * | 8/1999 | Dysarz | 114/218 |
| 5,967,075 | A | * | 10/1999 | Johansen | 114/230.1 |
| 6,647,911 | B1 | * | 11/2003 | Solterbeck | 114/230.26 |

* cited by examiner

*Primary Examiner*—Leslie A. Braun
*Assistant Examiner*—Jon Szumny
(74) *Attorney, Agent, or Firm*—Milde & Hoffberg LLP

(57) ABSTRACT

A small, no-tools-required device, for example constructed of weather and UV resistant glass-filled nylon, that is inserted into the gaps between the deck boards of any conventionally constructed outdoor deck, then turned 90° like a key and released. Once tension is applied to the device through an attachment, for example using an elastic strap, a locking tab engages against the underside of the deck boards and the stabilizer tab at the opposite end of the device from the attachment prevents the device from twisting. The device can then be used to secure any items on the surface of the deck and prevent unexpected shifting or moving due to wind, weather, or any other unforeseen force. It is installed or removed in seconds and causes no damage to the deck itself.

15 Claims, 3 Drawing Sheets

TIE DOWN DEVICE

RELATED APPLICATIONS

The present application claims benefit of priority from U.S. Provisional Patent Application No. 60/419,763, filed Oct. 21, 2002, the entirety of which is expressly incorporated herein by reference.

FIELD OF THE INVENTION

The present invention relates to a device that provides a means for fastening and/or securing items and accessories by means of tension on an expanded portion inserted between slats.

BACKGROUND OF THE INVENTION

Outdoor decks are typically constructed of 5/4" wood or composite deck boards over a structural grid. The typically recommended standard for spacing these boards is "the size of a 16*d* nail" or roughly 3/16", to allow for proper drainage of water from the deck surface and to account for shrinkage of the deck boards themselves. Through aging, and as a result of board and installation tolerances, the actual spacing may vary somewhat.

Completed decks are used for a variety of residential and/or commercial activities. Decks create more recreational space and extend indoor areas outside. During the summer months, decks often become the central entertaining space in the home, alternating as substitute dining rooms, living rooms, and family rooms. Decks are built as elaborate architectural showpieces, intimate private balconies, family gathering spaces, or simply fair weather fun spots around pools or gardens, just about anywhere people desire outdoor recreational space. These decks are subsequently outfitted with various types of patio furniture and other outdoor living accessories. It is these accessories that are subject to unexpected changes in position that may result in injury to occupants of the deck or property and/or other collateral damage.

Securing outdoor furniture or other recreational or decorative items to the surface of the deck is typically performed using permanent options (i.e., eye hooks, screws, nails) that are unsightly and are invasive to the structure of the deck itself.

Decks are similar in construction to docks and piers. A number of devices have been proposed for mooring of vessels. Moorings are almost always temporary.

See, U.S. Pat. Nos. D29,041; D58,112; D175,485; D205,682; D273,176; D321,470; D411,099; D427,506; 849,023; 1,967,427; 2,265,330; 2,688,289; 3,259,346; 3,381,925; 3,704,875; 4,235,409; 4,297,963; 4,344,378; 4,803,794; 5,120,016; 5,542,367; 5,625,974; 5,690,042; 5,733,082; 5,873,319; 5,941,191; 5,967,075; 6,295,942; and 6,497,067, each of which is expressly incorporated herein by reference.

SUMMARY OF THE INVENTION

A preferred embodiment of the present invention provides a temporary and easily removable device requiring no tools to install, that is designed to protect the occupants and accessories of the deck by safely, conveniently, and economically providing a anchoring point to which items such as patio furniture, barbecue grills, poolside accessories, and any other unsecured items that might occupy a deck may then be secured through the use of a secondary tie down cord or other strap.

According to a preferred design, an axially enlarged portion of a tie down device, spaced from a body of the device by an extension, is inserted between slats of a deck, and then turned, so that the enlarged portion engages the boards, and therefore cannot be retracted when under tension. However, when tension is released, the tie town may then be turned so that the axially enlarged portion aligns with the gaps between boards, and may then be retracted.

The tie down is preferably configured such that, when under tension along the thickness axis of the boards, it pivots such that the deck boards are compressed between the axially enlarged portion and a top engaging portion, thus locking the tie down in position, for example to prevent twisting. Thus, in contrast to typical mooring device designs, the tie down is not required to have a lateral force to compressively engage the dock boards.

Preferably, when under axial tension, a narrow portion of the body of the device, distal from the extension, is inserted in the gap between the slats, to further resist twisting or rotation.

Thus, a preferred embodiment of the invention comprises an axially enlarged portion spaced from a body by an extension, a tensile portion adapted for applying a tension from an object to be retained, a top engaging portion, and a narrow portion of the body.

The top engaging portion preferably comprises a fulcrum, which acts as a leading contact surface against the top of the boards, and a stop surface, which limits rotation of the tie down device about the fulcrum. The narrow body portion extends downward, from the remainder of the body, toward the axially enlarged portion, from the stop surface. The tensile portion defines an aperture located opposite the narrow portion of the body with respect to the fulcrum, spaced from the fulcrum such that, when the tie down is under tension, and therefore pivots to engage the axially enlarged portion and fulcrum against the upper and lower board surfaces, the aperture is between the axially enlarged portion and the fulcrum with respect to a projection along the thickness axis of the boards. Of course, if the deck varies from a nominal thickness, e.g., 5/4", then the position of the aperture along the aforementioned projection will deviate.

The tie down may be formed of metal, such as steel or aluminum, or engineered resins, such as nylon (e.g., Nylon 6,6), Tefzel®, Zytel®, ABS, polypropylene, copolymers, filled resins, composites or multicomponent construction. Preferably, the tie down is integral, and after fabrication is a single component.

A particularly preferred embodiment of the present invention advantageously provides a small, no-tools-required device constructed of weather and UV resistant glass-filled nylon, for example produced by an injection molding process, that is inserted into the gaps between the deck boards of any conventionally constructed outdoor deck, then used to secure any items on the surface of the deck and prevent unexpected shifting or moving due to wind, weather, or any other force. The lower body portion is inserted through the structural spacing (gap) between any two deck boards of a conventionally constructed outdoor deck, rotated until the top body portion is in line with the gap and the locking tab and wings are perpendicular with the same gap, then the device is released. The integral loop on its forward end then allows for attachment of any standard elastic tie-down cord. Once tension is applied and maintained in an upward draw via the elastic cord attached to the integral loop, the device is locked in place and prevented from twisting, thus securing whatever item is being held in place by the attached elastic cord.

It is therefore an object of the invention to provide a tie down device for engaging between spaced parallel slats, have a nominal thickness and spacing, comprising a shaft, having a first end and a second end, and an axis, having a length greater than the nominal thickness of the slats, and a diameter less than the slat spacing; an axially elongated portion, located at the first end of the shaft, comprising at least one member extending for a distance greater than the slat spacing at right angles from the axis of the shaft length, and having a thickness of less than the slat spacing; a body portion, located at the second end of the shaft, having a stop surface, an attachment region, and a stabilizer, extending from the stop surface toward the axially elongated portion, being displaced from the axis of the shaft, and having a thickness less than the slat spacing, the attachment region is located on the body on an opposite side with respect to the stabilizer, and offset from the axis of the shaft, wherein the stop surface is oriented with respect to the axially elongated portion such that, when a force is applied to the attachment region along a thickness axis of the slats, the stabilizer is inserted within the spacing between the slats to an extent limited by the stop surface acting on the slats.

The attachment portion may comprise an aperture through the body, or a fixture extending from the body. Preferably, the attachment portion is displaced from the axis of the shaft by a distance approximately equal to a length of the shaft.

The device may further comprise a fulcrum, defined by a medial edge of the stop surface, the fulcrum extending to the second end of the shaft.

The slat spacing is preferably approximately 3/16", while the slat thickness is preferably a nominal 5/4" (actual about 1.0").

In a preferred embodiment, the shaft is about 1.25", the axially elongated portion and the stop surface each extend at least 0.75" from the shaft in each of opposite directions, at right angles to the stabilizer, and the stabilizer extends at least 0.50" into a space between the slats.

The device is preferably integral, and may be formed of metal, plastic, composites, or other suitable materials having sufficient strength, durability, and environmental properties. The device is preferably suitable for supplying a retaining force of at least 25 lbs. The device, for example, may be injection molded from a polymer, such as Nylon 6,6, which may be ultraviolet stabilized and glass filled. The device, in certain embodiment, may also be wire-formed, forged, die cast, sintered (e.g., from powdered metal), metal injection molded, metal powder casting; thermoformed, thermoset, machined, composite, or the like. According to one embodiment, the shaft is formed of a high tensile strength steel cable, which is overmolded with a plastic. One end of the cable is affixed to the axially elongated extension, and the other may be integral with the body or presented as a loop for the attachment portion.

It is another object of the invention to provide a tie down device for coupling a strap to a deck formed of spaced parallel slats, comprising a high tensile strength shaft, adapted for insertion between slats; an extension from the shaft at right angles to an axis of the shaft, extending at least a spacing width of the slats from the axis; a fulcrum, at an end of the shaft opposite the extension, merging into a stop surface extending from the shaft along an axis parallel to the extension; an attachment portion located axially displaced from a centerline of the shaft; and a stabilizer, extending from the stop surface toward the extension, on an opposite side of the fulcrum with respect to the attachment portion, at right angles to the fulcrum and at right angles to the shaft, adapted to extend into a space between slats when a force is applied to the attachment portion and to potentially clear the space between slats when no force is applied.

It is a further object of the invention to provide a tie down device, comprising a high tensile strength shaft, having a diameter less than about 3/16"; a portion extending at least about 3/16" from the shaft at right angles to an axis of the shaft; a surface, at an end of the shaft opposite the portion, extending at least about 3/16" along an axis parallel to the extension; an attachment portion located axially displaced from a centerline of the shaft; and a stabilizer, at an end of the shaft opposite the portion, extending at least about 3/16" along an axis at right angles to the extension and the axis of the shaft. The nominal dimensions of the device are, of course, related to the structure to which it is affixed, and therefore a nominal variation in slot width and depth will result in a variance in preferred device dimensions.

BRIEF DESCRIPTION OF THE DRAWINGS

For a fuller understanding of the nature of the present invention, reference should be made to the following description taken in conjunction with the accompanying drawings, in which.

DETAILED DESCRIPTION OF THE INVENTION

Figure 1:
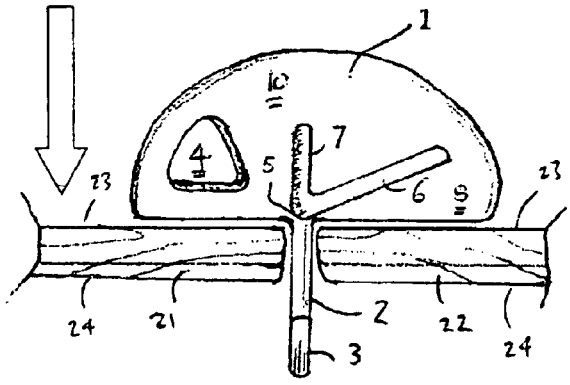
FIG. 1 shows a side view of the tie down according to the present invention in an insertion position between two boards.

The preferred embodiments of the present invention will now be described with reference to the drawings. Identical elements in the various figures are designated with the same reference numerals.

Figure 5:
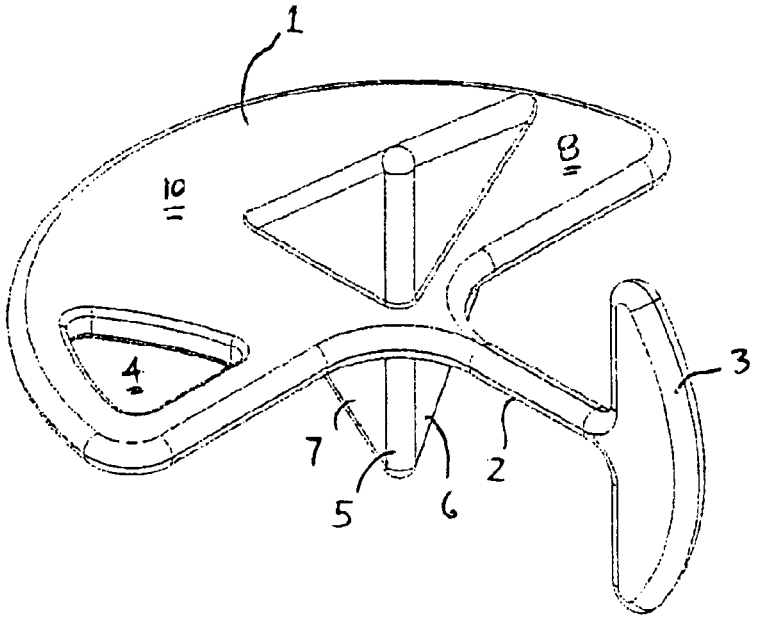
FIG. 5 shows a lower perspective view of the tie down device according to the present invention.

FIG. 5 shows a preferred embodiment of the tie down device 10, illustrating five major components: the body 1, located at an upper portion of the tie down device 10, comprising a tensile portion, which in this case is an aperture 4 defining an integral loop, a shaft 2, a fulcrum 5, located at the axial junction between the shaft 2 and body 1, a stop surface 6, extending from the body 1, a stabilizer 8, which is a downward flat portion extending from the body 1, and a axially elongated portion 3, located at a distal portion of the shaft 2 with respect to the body 1. The axially elongated portion 3 is elongated along an axis at right angles to the stabilizer 8. Thus, when the stabilizer 8 and shaft 2 are inserted between boards 21, 22 of a deck, the axially elongated portion 3 interferes with the boards and cannot be removed without rotating or severing the device.

The fulcrum 5 and stop surface 6 are supported by portions 7 extending laterally from the body 1.

The shaft 2 and axially elongated portion 3 have a maximum thickness of less than anticipated board 21, 22 spacing. In a typical construction of 5/4" deck boards, the boards 21, 22 are spaced about 3/16" apart. Therefore, the maximum thickness of the shaft 2 and axially elongated portion 3 is less than 1/4", preferably less than 3/16", and may be, for example 1/8". Due to materials fabrication and strength issues, the shaft 2 and axially elongated portion 3 are made as thick as possible while meeting the mechanical constraints of use. The stabilizer 8 also intrudes between spaces of the boards 21, 22, and therefore also must meet similar mechanical limitations.

The body 1 extending above the stop surface 6 is not particularly limited in size or shape, but is preferably also about the same thickness as the shaft 2, e.g., ⅛" to3⁄16".

The shaft 2 is preferably 1.25" (for use with ⅝" nominal deck board), but may have different length depending on the application. It is noted that ⅝" deck board is actually about 1" thick, and therefore the shaft is about ¼" longer than the thickness of the boards 21, 22.

The aperture 4 defining the integral loop is of sufficient size to insert a hook from a retaining strap (not shown), and is for example a triangle about 0.70" at its base and 0.74" in height, with the base of the triangle offset slightly perpendicular with the junction of the shaft 2 and body 1. The aperture 4 is located on a portion of the body 1 opposite from the stabilizer 8 with respect to the shaft 2, displaced from the axis of the shaft 2 by such an amount that, when the shaft 2 is inclined such than the stop surface 6 and axially elongated portion 3 abut the upper 23 and lower 24 surfaces of the boards 21, 22, than the projection of the aperture along the thickness axis of the boards 21, 22 is located over the shaft.

Figure 6:
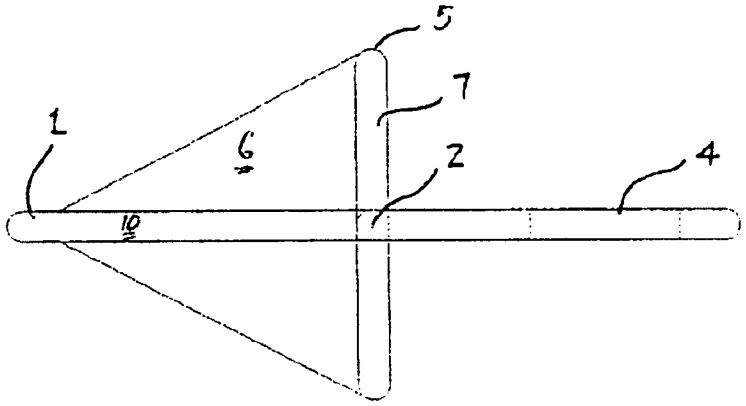
FIG. 6 shows a top view of the tie down device according to the present invention.

According to a preferred embodiment, the tie down device comprises an integral part, including a top body 1 portion in the form of a half-circle of 3.5' diameter and an overall thickness of 0.0125" with an integral loop aperture 4 on one end, outrigger "wings" protruding on each side from the vertical center line, formed of a stop surface 6, a fulcrum 5, and supporting portions 7, and a stabilizer 8 tab on the end of the body 1 opposite the integral loop; a shaft 2 extending downward from the vertical center line of the body 1; and a lower body portion, formed as an axially elongated member, having an axis of elongation at right angles to the stabilizer 8, referred to as the "locking tab", in the form of a smaller semi-circle of the same radius as the whole disc. As shown in FIG. 6, the "wings" may be tapered with increasing distance from the shaft 2 axis centerline.

Figure 2:
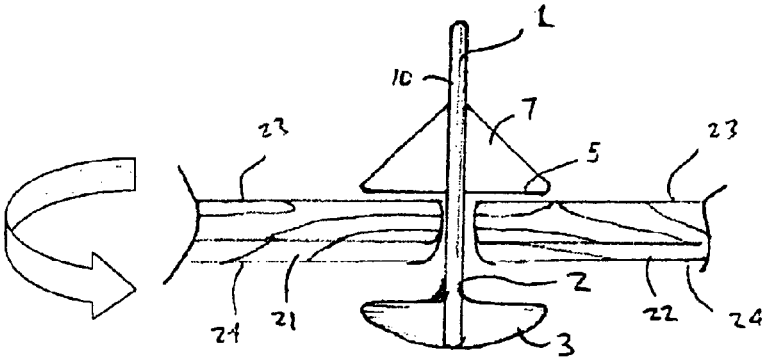
FIG. 2 shows a side view of the tie down of FIG. 1 after rotation into a usage position.
Figure 4:
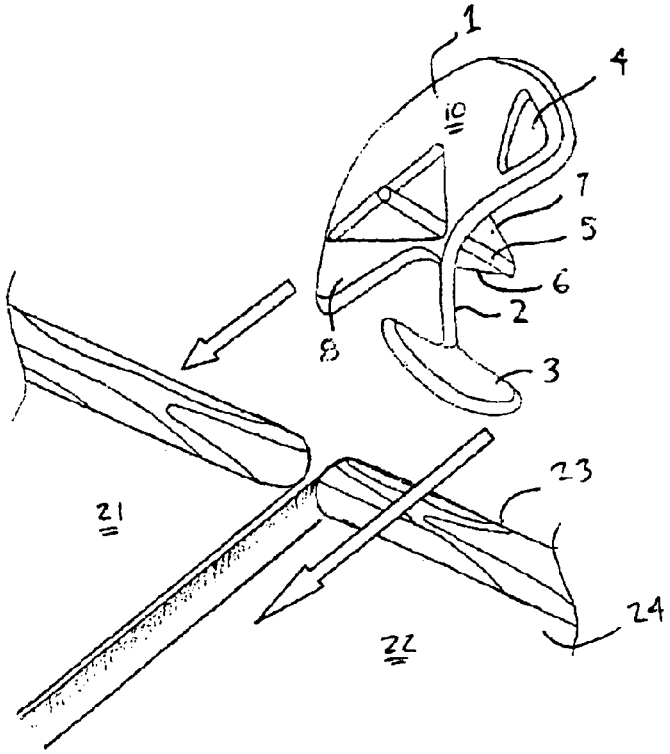
FIG. 4 shows a lower perspective view of the orientation of the tie down device according to the present invention in usage position, illustrating an alternate installation method.

In order to insert the tie down device 10, the axially elongated portion 3 is inserted between boards 21, 22 as shown in FIG. 1. After the tie down device 10 is fully inserted, the axially elongated portion 3 clears the bottom 24 surface of the boards 21, 22, and may then be rotated about the axis of the shaft 2, so that the axially elongated portion 3 interferes with the boards 21, 22, and may not be removed by direct tension, as shown in FIG. 2. Alternately, where free ends of the boards 21, 22 are accessible, the shaft 2 of the tie down device 10 may be slid between the slot between boards 21, 22, as shown in FIG. 4.

Figure 3:
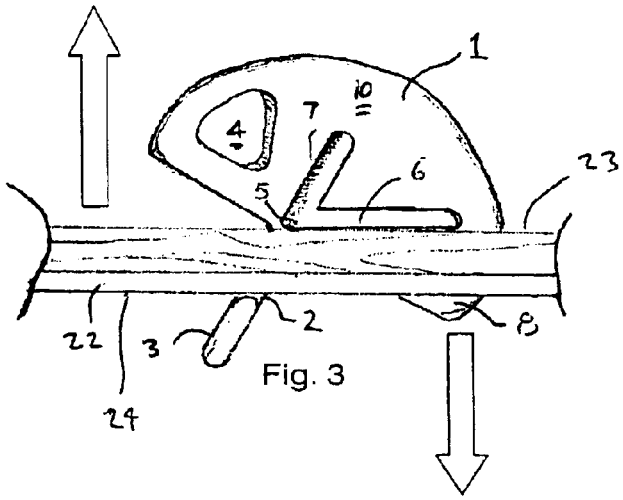
FIG. 3 shows a front view of the tie down of FIG. 2 in an engaged position, under axial tension at the aperture.

As shown in FIG. 3, when the tie down device 10 is under tension at the aperture 4, the body 1 pivots such that the shaft 2 becomes inclined with respect to the thickness axis of the boards 21, 22. The fulcrum 5 abuts the upper 23 surface of the boards 21, 22, while the axially elongated portion 3 abuts the lower 24 surface of boards 21, 22. Because of the location of the aperture 4, the tensile force causes a torque, rotating the body 1 to a position generally limited by the stop surface 6. In fact, the direction of the torque is not critical within normal operating conditions, so long as it has a significant component along the thickness axis of the boards 21, 22, assuring stability. The rotation of the body 1 due to the torque causes the stabilizer 8 to extend downward, below the upper surface 23 of the boards 21, 22, into the crevice between the boards 21, 22. The stabilizer 8 prevents rotation of the tie down device 10 about the shaft 2 when tension is applied to the aperture 4, thus assuring that the axially elongated portion 3 remains crossed with respect to the slot between the boards 21, 22.

As tension is applied and maintained in an upward draw via a strap, such as an elastic cord attached to the integral loop, the device is locked in place and prevented from twisting, thus securing whatever item is being held in place by the attached elastic cord.

There has thus been shown and described a novel method for a tie down device. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A tie down device for engaging between spaced parallel slats, have a nominal thickness and spacing, comprising:

(a) a shaft, having a first end and a second end, and an axis, having a length adapted to be greater than the nominal thickness of the slats, and a diameter adapted to be less than the slat spacing;

(b) an axially elongated portion, located at said first end of said shaft, comprising at least one member extending for a distance greater than the slat spacing at right angles from said axis of said shaft length, and having a thickness of less than the slat spacing;

(c) a body portion, located at said second end of said shaft, having a stop surface, an attachment region, and a stabilizer, extending from said stop surface toward said axially elongated portion, being displaced from said axis of said shaft, and having a thickness less than the slat spacing, said attachment region is located on said body on an opposite side with respect to said stabilizer, and offset from said axis of said shaft, wherein said stop surface is oriented with respect to said axially elongated portion such that, when a force is applied to said attachment region along a thickness axis of the slats, said stabilizer is inserted within the spacing between the slats to an extent limited by said stop surface acting on said slats.

2. The device according to claim 1, wherein said attachment portion comprises an aperture through said body.

3. The device according to claim 1, wherein said attachment portion is displaced from said axis of said shaft by a distance approximately equal to a length of said shaft.

4. The device according to claim 1, further comprising a fulcrum, defined by a medial edge of said stop surface, said fulcrum extending to said second end of said shaft.

5. The device according to claim 1, wherein said slat spacing is approximately3⁄16".

6. The device according to claim 1, wherein said slat nominal thickness is approximately ⅝".

7. The device according to claim 1, wherein said shaft is about 1.25", said axially elongated portion and said stop surface each extend at least 0.75" from said shaft in each of opposite directions, at right angles to said stabilizer, and said stabilizer extends at least 0.50" into a space between the slats.

8. The device according to claim 1, wherein said device is integral and formed of a metal.

9. The device according to claim 1, wherein said device is injection molded from a polymer.

10. The device according to claim 1, wherein said device is formed of an ultraviolet stabilized glass filled polymer.

11. The device according to claim 1, wherein said device is formed from an injection molded engineered region.

12. The device according to claim 1, wherein said device comprises a formed wire.

13. The device according to claim 1, wherein said device is formed as a composite of a high tensile strength element within said shaft and an over-molded body.

14. A tie down device for coupling a strap to a deck formed of spaced parallel slats, comprising:

(a) a high tensile strength shaft, adapted for insertion between slats;

(b) an extension from said shaft at right angles to an axis of said shaft, adapted to extend least a spacing width of the slats from said axis;

(c) a fulcrum, at an end of said shaft opposite said extension, merging into a stop surface and extending from said shaft along an axis parallel to said extension;

(d) an attachment portion located axially displaced from a centerline of said shaft; and (e) a stabilizer, extending from said stop surface toward said extension, on an opposite side of said fulcrum with respect to said attachment portion, at right angles to said fulcrum and at right angles to said shaft, adapted to extend into a space between the slats when a force is applied to said attachment portion and to potentially clear the space between the slats when no force is applied.

15. The device according to claim 14, formed as an integral unit of a molded polymer.

* * * * *